United States Patent [19]

Burley

[11] Patent Number: 4,749,546

[45] Date of Patent: Jun. 7, 1988

[54] NICKEL BASED ALLOYS FOR HIGH TEMPERATURE APPLICATIONS

[75] Inventor: Noel A. Burley, Mitcham, Australia

[73] Assignee: BELL-IRH Proprietary Limited, Lidcombe, Australia

[21] Appl. No.: 905,502

[22] Filed: Sep. 10, 1986

[30] Foreign Application Priority Data

| | | | |
|---|---|---|---|
| Sep. 12, 1985 | [AU] | Australia | PH2397 |
| Sep. 24, 1985 | [AU] | Australia | PH2587 |
| May 7, 1986 | [AU] | Australia | PH5792 |

[51] Int. Cl.[4] ..... C22C 19/05

[52] U.S. Cl. ..... 420/442; 420/443

[58] Field of Search ..... 420/442, 443; 148/427

[56] References Cited

U.S. PATENT DOCUMENTS 2,422,489 6/1947 Kihlgren et al. ..... 219/8

FOREIGN PATENT DOCUMENTS 2211535 12/1973 France .
108164 7/1917 United Kingdom .
507167 7/1939 United Kingdom .
766392 10/1954 United Kingdom .

*Primary Examiner*—R. Dean
*Attorney, Agent, or Firm*—Murray and Whisenhunt

[57] ABSTRACT

A nickel-based alloy containing by weight 13.5% to 14.5% chromium and 1.0% to 1.5% silicon, characterized in that it also contains at least one element selected from the group consisting of molybdenum, tungsten, niobium and tantalum, and optionally also containing up to 0.5% magnesium and/or up to 0.2% cerium. The alloys of the invention possess a comprehensive range of enhanced properties at high temperatures.

12 Claims, 4 Drawing Sheets

Annealing Trials

As rolled x500

1 hour 600 deg.C x500

1 hour 800 deg.C x500

1 hour 1000 deg.C x500

NICKEL BASED ALLOYS FOR HIGH TEMPERATURE APPLICATIONS

Figure 1:
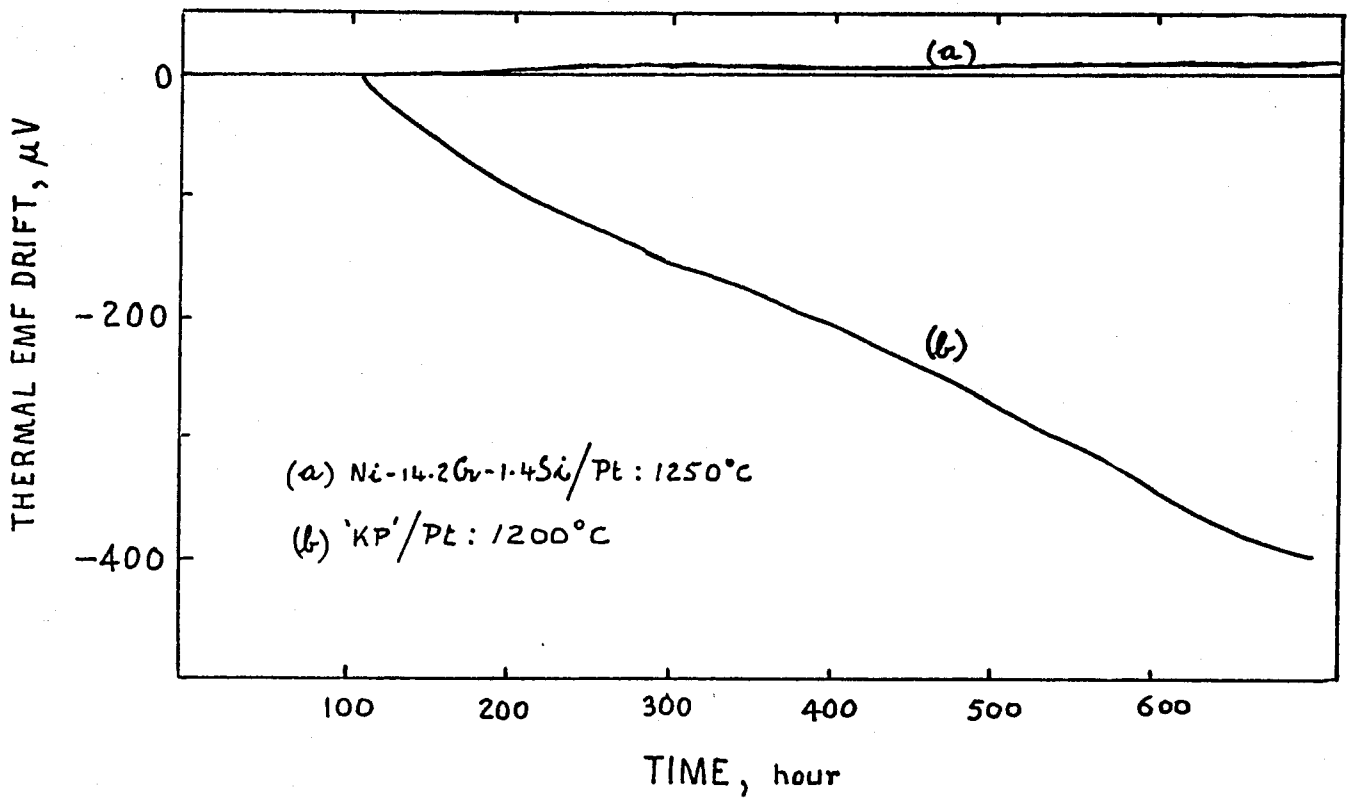

This invention relates to nickel-based alloys for high-temperature service.

The alloys of the present invention possess a comprehensive range of enhanced properties at high temperatures and are therefore suitable for a wide variety of applications among which may be mentioned structural components of solid form in a variety of sections including tubular sections for furnaces, retorts and other heated enclosures of many kinds, protective sheathing for a number of devices including thermocouples, thermocouple cables, resistive heating elements, heat sensing and heat tracing cables, as well as igniter devices, rocket nozzles and other components for many other applications. A particular application of the alloys of this invention is for the sheathing material of mineral-insulated metal-sheathed electrical conductor cable for thermocouples and other devices including thermocouples where the sheath forms one of the thermoelement conductors of the thermocouple.

The alloys of this invention have improved high-temperature properties and are characterized, in particular, by possessing properties including:

(i) Outstanding resistance to high-temperature gas corrosion, more particularly oxidation resistance under conditions of both constant temperature and also cycling temperatures of either a continuous or intermittent kind and over a wide range of partial pressures of oxygen, (ii) highly stable thermoelectric properties more particularly ultra-high stability of thermoelectromotive force and Seebeck coefficient over a wide range of temperatures and under conditions of both constant temperature and cycling temperatures of either a continuous or intermittent kind and over a wide range of partial pressures of oxygen and which properties are significantly and substantially enhanced over those of other nickel-base alloys for high-temperature applications, (iii) high values of tensile strength at high temperatures and a high degree of retention of tensile strength at high temperatures, and (iv) a high degree of mechanical workability at high temperatures by processes such as hot extrusion and at low temperatures by processes such as cold drawing, cold swaging and cold pilgering.

The alloys of this invention may be used as cast, and in the hot-worked, cold-worked or fully annealed conditions. While these alloys have excellent properties in both the cast and wrought conditions, these properties can be improved and stabilized by annealing treatments at temperatures above their minimum recrystallization temperatures. This stabilization applies particularly to their thermoelectric properties.

Whilst there are several nickel-base alloys which have some but not all of the abovementioned favourable properties there are none, to our knowledge, that possess all these properties in the one alloy.

The most common alloys conventionally used for the particular application of sheathing materials of metal-sheathed mineral-insulated conductor cables are various grades of stainless steel and inconel. These alloys are significantly deficient in one or more of the properties of which the alloys of the present invention are possessed all in excellent high measure.

The present inventor has proposed (Australian Petty Patent No. 548519 of Dec. 3, 1985, and Australian Patent Application No. 41675 of Apr. 24, 1985) that the best existing alloys for the particular application of sheathing materials of mineral-insulated metal-sheathed conductor cable are alloys hitherto not used for this purpose, namely the nickel alloys of his own invention known as NICROSIL (typically containing 14.2% wt. Cr and 1.4% wt. Si) and NISIL (typically containing 4.4% wt. Si and 0.1% wt. Mg). Whilst these alloys show most excellent resistance to high-temperature gas corrosion and are possessed of ultra-high thermoelectric stability, they do not exhibit the desired excellent degrees of tensile strength at high temperatures which are required for sheathing alloys for metal-sheathed mineral-insulated cables for the most demanding of the wide variety of applications involved. Such most demanding applications include some found, for examples amongst others, in the nuclear, aerospace and electronics industries.

Other alloys which have actual or potential application as sheathing for metal-sheathed mineral-insulated cables, such as stainless steel, inconel, nicrosil and nisil, are deficient in some or all of the aspects of very high resistance to gas corrosion, ultra-high thermoelectric stability, very high tensile strength and retention of strength at the highest application temperatures involved.

Because the alloys of the present invention possess a comprehensive range of these enhanced properties, they are suitable for a wide variety of applications at high temperatures. These applications may occasionally require only one or a combination of the improved properties. The excellent resistance to high-temperature gas corrosion and excellent high-temperature tensile strength of the new alloys are important properties for load bearing structural components in furnaces, retorts, reactor vessels, heated enclosures of many kinds, gas turbine engines, rocket nozzles and a wide range of similar equipment. The ultra-high thermoelectric stability of the new alloys is important for wires and tubes for thermoelement conductors and protective sheathing, respectively, for thermocouples particularly of the metal-sheathed mineral-insulated type of construction.

A particular application of the new alloys is in mineral-insulated metal-sheathed conductor cables for thermocouples, heater elements, heat sensing and heat tracing cables, stagnation probe transducers for gas turbine engines, gas flues, and like applications. It is in such applications that the unique combination of excellent properties at high temperature of the alloys of this invention of gas-corrosion resistance, thermoelectric stability and retained high tensile strength are of optimum benefit. In some of these applications a combination of the highest possible values of these properties is essential.

In this respect, our studies and extensive test programmes have shown that the desired combination of high property values of gas corrosion resistance and thermoelectric stability are achievable using a base-alloy composition of nickel-chromium-silicon in component concentrations which optimize these properties whilst retaining a single solid solution phase structure, which is an important feature of the preferred alloys of the invention. The enhanced high-temperature strength is achieved by the addition of one or more supplementary elemental components. It is believed that such addition achieves the required strengthening effect by a mechanism of crystal lattice modification appropriate to single solid solution structures. The desired effect of strengthening at high temperatures can, in fact, be achieved by a number of optional compositional variants which are the result of the addition of one or a number of optional strengthening elements to the base nickel-chromium-silicon lattice structure.

The preferred embodiments of the range of possible alloys are set down in Table 1.

TABLE 1

| Component | Alloy Option (composition - percent weight) | | | | | |
|---|---|---|---|---|---|---|
| Element | 1 | 2 | 3 | 4 | 5 | 6 |
| Cr | | | 13.5 to 14.5 | | | |
| Si | | | 1.0 to 1.5 | | | |
| Mg | | | 0.2 maximum | | | |
| Ce | | | 0.2 maximum | | | |
| Mo | 1.0 to 5.0 | — | — | — | 1.0 | 3.0 |
| W | — | 0.5 to 1.0 | — | — | 0.5 | 1.0 |
| Nb | — | — | 1.0 to 3.0 | — | 1.0 | — |
| Ta | — | — | — | 1.0 to 2.0 | 1.0 | — |
| Ni | | | Balance | | | |

Figure 2:
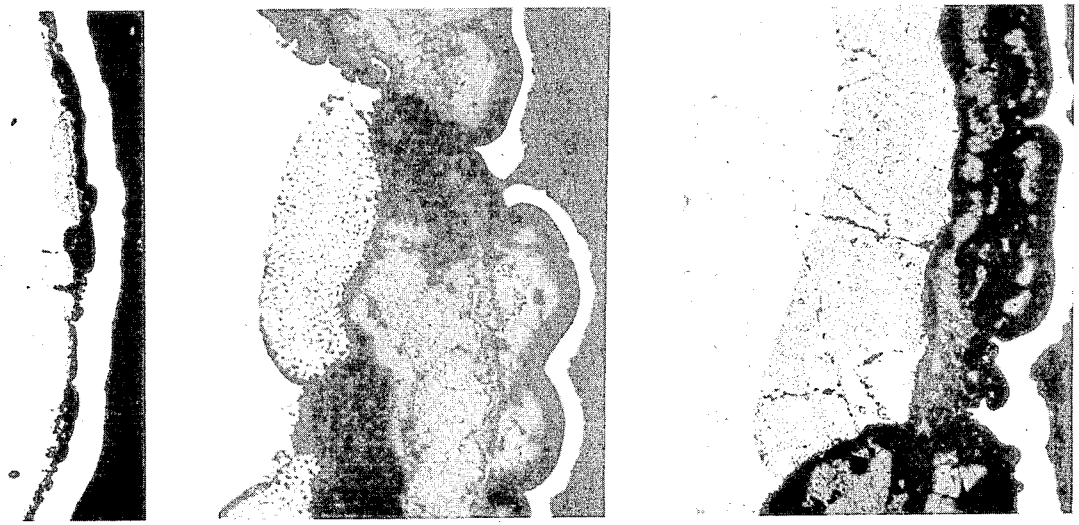
Figure 3:
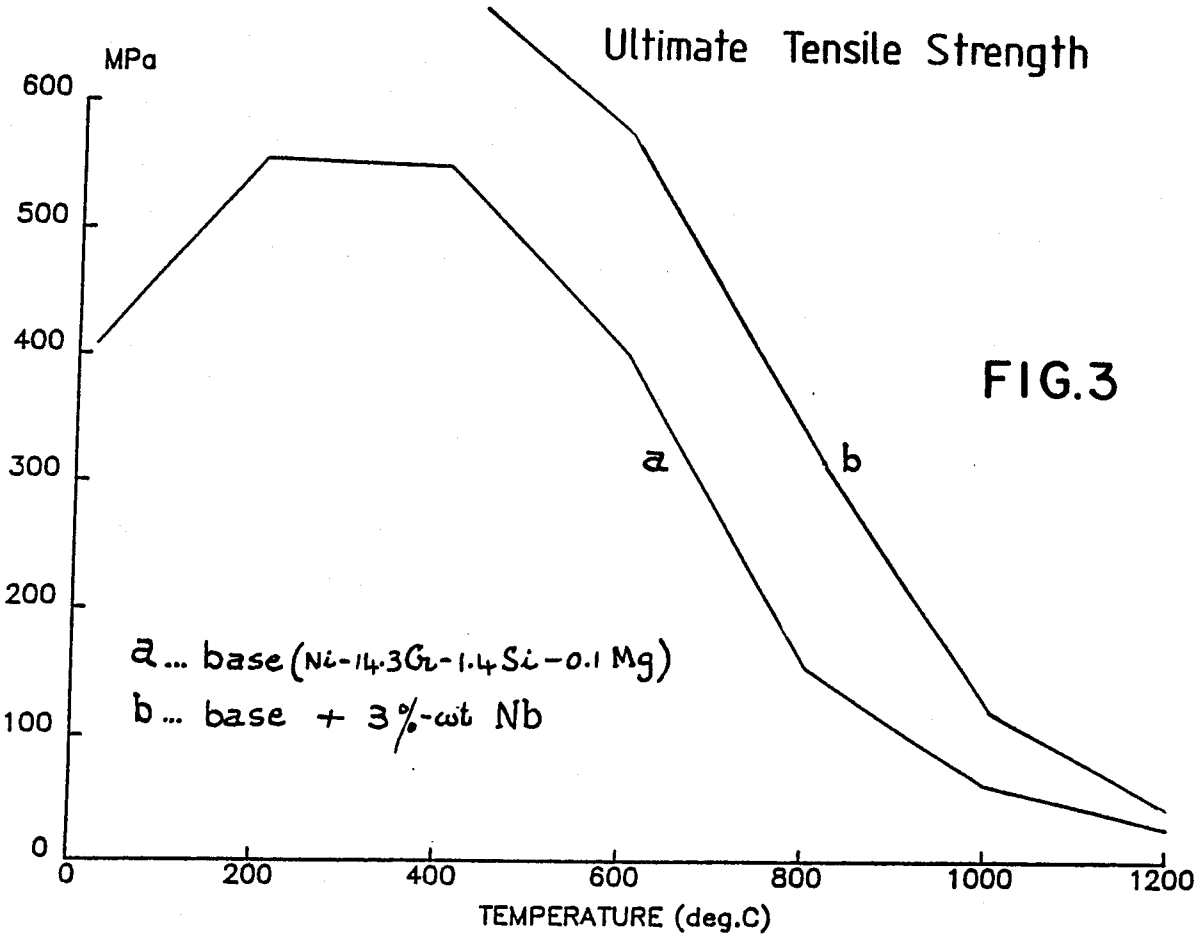
Figure 4A:
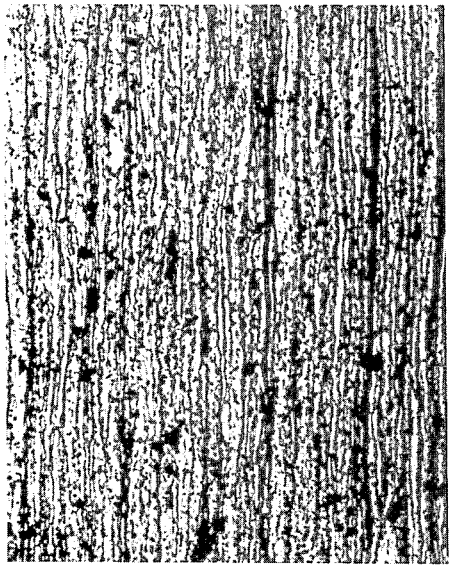
Figure 4B:
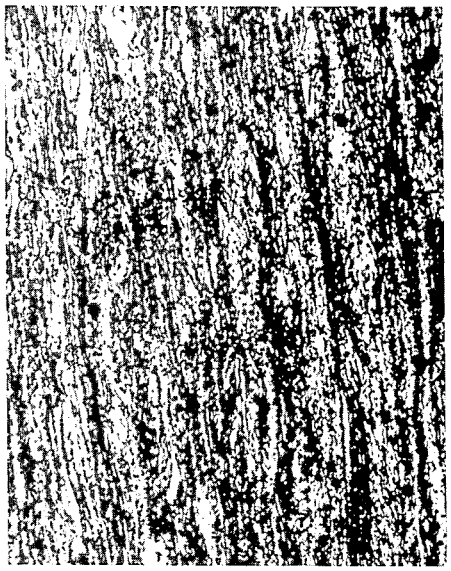
Figure 4C:
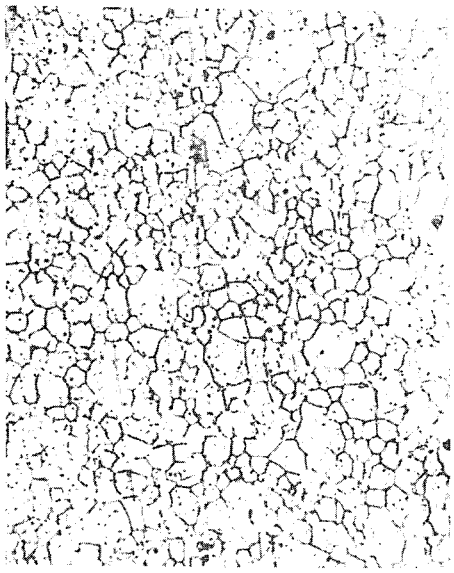
Figure 4D:
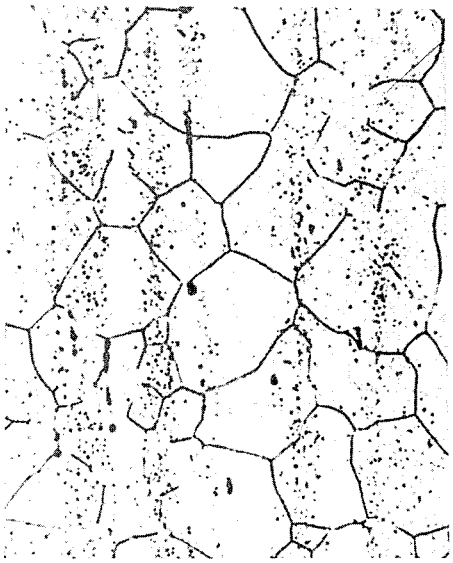

In the ensuing discussion reference is made to the accompanying figures and diagrams, wherein:

FIG. 1 shows graphical plots of long-term drifts in thermoelectromotive force of 3.3 mm diameter thermoelements of (Instrument Society of America) type KP alloy Ni-9.3Cr-0.4Si (percent weight) versus platinum, and of similar thermoelements of Ni-14.2Cr-1.4Si-0.05Mg (percent weight) versus platinum on exposure in air at 1200° C. and 1250° C., respectively. The drifts are changes from thermoelectromotive force output values existent after 100 hours of constant temperature exposure;

FIG. 2 are photomicrographs which show oxide structures in Instrument Society of America type KP alloy Ni-9.3Cr-0.4Si (percent weight) (top two panels) and in alloy Ni-14.2Cr-1.4Si-0.05Mg (percent weight) (bottom panel) resulting from constant-temperature exposure of 3.3 mm diameter specimens in air for 800 hours at 1200° C. The outer white annular zone is a layer of electrodeposited copper which was applied to support the fragile oxides;

FIG. 3 shows a graphical plot of the ultimate tensile strength of Ni-14.3Cr-1.4Si-0.1Mg alloy (percent weight) as a function of temperature. The graph also shows a plot of the tensile strengths of one of the preferred embodiments of the alloys of this invention as a function of temperature; Tables 2 and 3 below include further experimental data; and FIG. 4 are photomicrographs which show the grain structure, magnified 500 times, of initially as-rolled (to 85% reduction of cross-section originally 8 mm) Ni-14.3Cr-1.4Si-0.1Mg alloy (percent weight) as a function of annealing for one hour at temperatures of 600° C., 800° C., and 1000° C.

In order to achieve the desired optimum combination of properties in the alloys of this invention, the alloy microstructure must comprise only one equilibrium phase which is a terminal solid-solution. The base ternary alloy of nickel-chromium-silicon, in the concentration ratios described in the preferred embodiments of Table 1, is of such single solid-solution equilibrium structure. In practice, we have found that the addition of the preferred strengthening elements molybdenum, tungsten, niobium and tantalum, either in the single or in the combined concentrations of the preferred embodiments, does not exceed limits of solid solubility in the ternary Ni-Cr-Si base alloy. Therefore no second phases, either solid-solutions or intermetallic compounds, are formed. Furthermore, we have found that the preferred alloys are amenable to both hot and cold mechanical working to change their shape because they possess adequate cold ductility, and that their microstructural recrystallization temperatures are about 800° C. so they can readily be softened by annealing above this temperature when they are work hardened by cold deformation. Furthermore, any property variations across a section of the preferred alloys due to compositional inhomogeneities in as-cast structures can be readily minimized by homogenizing heat-treatments.

The compositions of the alloys in the present invention require the careful selection of component elements of very high purity and the achievement of the correct proportions of each by adequate control of melting and casting techniques. In all cases the effects of one component element depend on those of the others and hence there is a synergistic interdependence of the elements within the overall compositions. In general, concentrations of alloying elements outside the compositional ranges specified for the alloys of this invention cause degradation of the optimum levels of property values of gas-corrosion resistance, thermoelectric stability and tensile strength, all at high temperatures.

Nickel-chromium-silicon alloys of the single solid-solution phase type, in the concentration ranges (9 to 15) % wt. Cr and (0.3 to 1.5) % wt. Si show relatively high thermoelectric stability at elevated temperatures in air. The actual degrees of instability of thermoelectromotive force output and Seebeck coefficient are functional not only upon temperature of exposure and the oxygen partial pressure of the air, but also upon the specific solute concentrations of chromium and silicon in the base nickel. The highest degree of stability of thermoelectromotive force is achievable only by selecting optimum critical concentrations of chromium and silicon in nickel.

FIG. 1 shows the degree of thermoelectric instability exhibited by the most common Ni-Cr-Si alloys used as thermocouple thermoelements, namely the Ni-9.3% wt. Cr-0.4% wt. Si alloy designated type KP by the Instrument Society of America. This instability is expressed as drift in thermoelectromotive force in microvolt as a function of time of exposure in air at 1200° C. The figure also shows the greatly enhanced thermoelectric stability of the base Ni-Cr-Si alloy which is the preferred embodiment of this invention. For example it can be seen that the drift in the thermoelectromotive force of the type KP alloy after 700 hours is about minus 400 microvolt at 1200° C., but the Ni-Cr-Si base alloy which is the preferred embodiment of this invention shows virtually no drift in thermoelectromotive force even at the higher temperature of 1250° C.

FIG. 2 shows the degree of oxidation occurring in the same type KP alloy after exposure for 800 hours in air at 1200° C. It is evident that not only is there massive external scale developed on the surface of the alloy but also that a process of internal oxidation has resulted in the massive precipitation of oxide particles of the component elements chromium and silicon in the internal matrix of the alloy. We have found that this latter process of internal oxidation produces gross changes in the solute concentrations of chromium and silicon and it is these changes in concentration, which are temporally progressive, that are the cause of the relatively high degree of instability of thermoelectromotive force in the KP alloys under the stated conditions. Of considerable significance is the evidence in the same figure that for the Ni-Cr-Si base alloy of the preferred embodiments of this invention there is very little oxide, either as external scale or as internal oxide precipitates. The consequent virtual absence of compositional changes in solute concentrations is the reason for the ultra-high thermoelectric stability of this base alloy.

The preferred strengthening elements of this invention, namely molybdenum, tungsten, niobium and tantalum, either in the single or the combined concentrations of the preferred embodiments, will not deleteriously affect the oxidation resistance of these preferred alloys in any significant way.

FIG. 3 shows the tensile strength of the Ni-Cr-Si base alloy which is the preferred embodiment of this invention as a function of temperature in the fully annealed condition. Whilst the tensile strength of this alloy above 1000° C. is adequate for many general purposes for which the alloys of this invention are intended, there are a number of critical applications in the nuclear, aerospace, electronics and general engineering fields for which the strength values shown in FIG. 2 are inadequate. The Ni-Cr-Si alloy which is the base alloy of this invention is significantly strengthened at high temperatures by the addition of small amounts of one or more of the elements molybdenum, tungsten, niobium and tantalum.

The superior properties of specific examples of alloys according to the invention are shown in the following Tables 2 and 3.

TABLE 2

TENSILE STRENGTHS AT ELEVATED TEMPERATURES

| Nickel-Base Alloy (wt. %) | Temperature (°C.) Room 1 | Room 2 | 400 1 | 400 2 | 600 1 | 600 2 | 800 1 | 800 2 | 1000 1 | 1000 2 | 1200 1 | 1200 2 |
|---|---|---|---|---|---|---|---|---|---|---|---|---|
| (Base) 14.3Cr—1.4Si—0.1Mg | 498 | 211 | 550 | 143 | 423 | 136 | 178 | 86 | 67 | 25 | 27 | |
| Base + 0.5W | 621 | 229 | 576 | 155 | 483 | 140 | 217 | 109 | 72 | | 27 | |
| Base + 3.0Mo | 648 | 262 | 599 | 180 | 523 | 164 | 263 | 146 | 86 | | 32 | |
| Base + 3.0Nb | 635 | 288 | 646 | 201 | 561 | 196 | 311 | 189 | 106 | | 31 | |
| Base + 1.0Ta | 635 | 248 | 571 | 158 | 491 | 140 | 222 | 120 | 70 | | 28 | |
| Base + 1.0Mo—1.0Nb + 0.5W—1.0Ta | 651 | 258 | 585 | 170 | 513 | 145 | 278 | 155 | 84 | | 32 | |
| Base + 0.04 Ce | 618 | 229 | 553 | 143 | 465 | 135 | 200 | 102 | | | | |

Notes:
Columns 1 give Ultimate Tensile Strengths in megapascal ($N.mm^{-2}$)
Columns 2 give 0.2% Proof Stresses in megapascal ($N.mm^{-2}$)

TABLE 3

DUCTILITIES AT ELEVATED TEMPERATURES

| Nickel-Base Alloy (wt. %) | Temperature (°C.) Room 1 | Room 2 | 400 1 | 400 2 | 600 1 | 600 2 | 800 1 | 800 2 | 1000 1 | 1000 2 | 1200 1 | 1200 2 |
|---|---|---|---|---|---|---|---|---|---|---|---|---|
| (Base) 14.3Cr—1.4Si—0.1Mg | 28 | 33 | 51 | 68 | 38 | 45 | 52 | 37 | 97 | 73 | 126 | 90 |
| Base + 0.5 W | 49 | 73 | 53 | 77 | 41 | 47 | 80 | 63 | 117 | 71 | 125 | 100 |
| Base + 3.0 Mo | 55 | 72 | 56 | 73 | 57 | 62 | 104 | 73 | 74 | 51 | 112 | 81 |
| Base + 3.0 Nb | 53 | 61 | 58 | 67 | 60 | 66 | 91 | 71 | 108 | 70 | 135 | 98 |
| Base + 1.0 Ta | 51 | 74 | 56 | 70 | 52 | 68 | 39 | 33 | 110 | 65 | 112 | 100 |
| Base + 1.0Mo—1.0Nb—0.5W—1.0Ta | 55 | 79 | 58 | 75 | 54 | 69 | 52 | 40 | 53 | 62 | 110 | 100 |
| Base + 0.04 Ce | 50 | 64 | 49 | 68 | 37 | 36 | 19 | 36 | | | | |

Notes:
Columns 1 give Ductilities by elongation (%)
Columns 2 give Ductilities by reduction in cross-sectional area (%)

Vacuum melted ingots of each separate alloy were extruded into desired shapes from which special test-pieces were machined. Tests to determine tensile strength and ductility at various temperatures were carried out using a standard test-piece 80 mm long×12.7 mm diameter, with a narrowed portion 32 mm long. The gauge length=5.65/A, where A=cross-sectional area of the test-piece. A KN Zwick universal testing machine, specially modified to facilitate the high-temperature tests, was used. Each test involved straining the test-piece at a rate of 0.002 mm/mm/min. up to the 0.5% proof stress and then at 3.2 mm/min. until fracture. Ductility was assessed by measuring the elongation of the test-piece between gauge marks and the reduction of cross-sectional area of the fracture face.

All alloys tested show substantial high-temperature stength increases over that of the base alloy. It is of great interest that the best of them has a simple addition of 3.0%-wt. niobium.

The strength increases for these alloys range from about 25% to about 75%. Despite the very high strength of the 3-Nb alloy, its ductility has not been adversely affected; indeed it is somewhat more ductile than the base alloy.

Table 4 summarizes the results of another experiment, in which the base alloy was nicrosil. The alloys of the present invention were compared with inconel-600 and stainless steel-310.

TABLE 4

| ALLOY | | ULTIMATE TENSILE STRENGTH ($N \cdot mm^{-2}$) | |
|---|---|---|---|
| IDENT. | COMPOSITION (weight %) | at 800° C. | % increase(+)/ decrease(−) |
| NICROSIL | Base alloy (Ni—14.2Cr—1.4Si) | 175 | |
| NPX-1 | Base + 0.5 W | 217 | +24 |
| NPX-2 | Base + 3.0 Mo | 263 | +50 |
| NPX-3 | Base + 3.0 Nb | 311 | +78 |
| NPX-4 | Base + 1.0 Ta | 222 | +43 |
| NPX-5 | Base + 1.0 Mo + 0.5 W + 1.0 Nb + 1.0 Ta | 278 | +27 |
| SS 310* | Fe—25Cr—20Ni—2.0Mn—1.5Si | 205 | +17 (Base) −34 (NPX-3) |
| INC 600* | (Ni + Co)—16Cr—7½Fe—1.0Mn—½Si—½Cu | 135 | −23 (Base) −57 (NPX-3) |

*SS 310 = stainless steel 310
INC 600 = Inconel 600

Inconel-600 is about 23% weaker than nicrosil and nearly 60% weaker than NPX-3. Stainless steel-310 is about 25% stronger than nicrosil, but is about 35% weaker than NPX-3.

Nicrosil is more oxidation resistant than either stainless steel-310 or inconel-600. There is some evidence to suggest that niobium improves the oxidation resistance of Ni-Cr-Si alloys, particularly in atmospheres of low oxygen partial pressure.

The strengthening elements, namely Mo, W, Nb and Ta, when added to the preferred base alloy of Ni-Cr-Si, in any combination, have effects one with another as stated above. These elements are therefore interchangeable to a certain degree. Alloys of the invention may therefore be compositionally variant in respect of their Mo, W, Nb and Ta contents to a greater degree than is indicated by the preferred embodiments described in Table 1. A second group of preferred embodiments of the alloys of this invention are therefore described as follows:

| Element | Concentration (% wt.) |
|---|---|
| Cr | 13.5 to 14.5 |
| Si | 1.0 to 1.5 |
| Mg | 0.5 maximum |
| Ce | 0.2 maximum |
| Mo | 5.0 maximum |
| W | 1.0 maximum |
| Nb | 3.0 maximum |
| Ta | 2.0 maximum |
| Ni | remainder, apart from impurities. |

An important feature of the alloys of this invention is that the kinetic processes governing the variation of the size and shape of their crystal grains must occur with sufficiently high velocity to make possible a predetermined choice of grain size by a simple heat treatment in which the parameters of temperature and (relatively short) time are mutually variable. This is because in different applications of the alloys different average grain sizes are desirable even obligatory.

FIG. 4 shows that the grain sizes of the Ni-Cr-Si base alloy of the preferred embodiments of this invention are inherently readily variable as a function of temperature.

The strengthening elements Mo, W, Nb, and Ta, of this invention do not have unduly large inhibitory effects either in the elevation of recrystallization temperatures or in the rates of grain growth in individual alloy embodiments.

It will be clearly understood that the invention in its general aspects is not limited to the specific details referred to hereinabove.

I claim:

1. A nickel-based alloy consisting essentially of, by eight, 13.5% to 14.5% chromium, 1.0% to 1.5% silicon, and the balance nickel, characterized in that it also contains at least one element selected from the group consisting of molybdenum, tungsten, niobium, and tantalum, in concentration by weight molybdenum: up to 5.0% maximum, tungsten: up to 1.0% maximum, niobium: up to 3.0% maximum, and tantalum: up to 2.0% maximum.

2. An alloy according to claim 1 having the following composition by weight:

| | % |
|---|---|
| Cr | 13.5 to 14.5 |
| Si | 1.0 to 1.5 |
| Mo (when present) | 1.0 to 1.5 |
| W (when present) | 0.5 to 1.0 |
| Nb (when present) | 1.0 to 3.0 |
| Ta (when present) | 1.0 to 2.0 |

and the balance nickel, apart from impurities.

3. An alloy according to claim 2 containing 1.0% Mo, 0.5% W, 1.0% Nb and 1.0% Ta.

4. An alloy according to claim 1 containing 3.0% Mo and 1.0% W.

5. An alloy according to claim 1, also containing up to 0.5% magnesium and/or up to 0.2% cerium.

6. An alloy according to claim 1, also containing up to 0.2% magnesium and/or up to 0.2% cerium.

7. An alloy according to claim 5 having the following composition by weight:

| | % |
|---|---|
| Cr | 13.5 to 14.5 |
| Si | 1.0 to 1.5 |
| Mg | 0.5 maximum |
| Ce | 0.2 maximum |
| Mo | 5.0 maximum |
| W | 1.0 maximum |
| Nb | 3.0 maximum |
| Ta | 2.0 maximum |
| Ni | remainder, apart from impurities. |

8. An alloy according to claim 1 or claim 5 containing from 0.10 to 0.20% magnesium.

9. An alloy according to claim 1 or claim 5 containing from 0.02% to 0.06% cerium.

10. An alloy according to claim 1 or claim 5 containing about 0.15% magnesium.

11. An alloy according to claim 1 or claim 5 containing about 0.04% cerium.

12. An alloy according to any one of claims 1 and 2 to 4, also containing 0.15% magnesium and 0.04% cerium.

* * * * *

UNITED STATES PATENT AND TRADEMARK OFFICE

CERTIFICATE OF CORRECTION

PATENT NO. : 4,749,546

DATED : June 7, 1988

INVENTOR(S) : Noel A. BURLEY

It is certified that error appears in the above-identified patent and that said Letters Patent is hereby corrected as shown below:

On the cover page, Item [73], "BELL-IRH Proprietary Limited" should read --BELL-IRH Limited--.

Signed and Sealed this

Fourteenth Day of February, 1989

*Attest:*

DONALD J. QUIGG

*Attesting Officer*

*Commissioner of Patents and Trademarks*